United States Patent [19]

Matsushita et al.

[11] 4,167,160

[45] Sep. 11, 1979

[54] TWO CYCLE LOOP SCAVENGING ENGINE HAVING UNEQUAL SCAVENGING PASSAGE OPENINGS

[75] Inventors: Yukio Matsushita; Kenichi Handa, both of Iwata, Japan

[73] Assignee: Yamaha Hatsudoki Kabushiki Kaisha, Iwata, Japan

[21] Appl. No.: 896,427

[22] Filed: Apr. 14, 1978

[30] Foreign Application Priority Data

Apr. 20, 1977 [JP] Japan ..... 52-50208[U]

[51] Int. Cl.[2] ..... F02B 33/04

[52] U.S. Cl. ..... 123/73 A; 123/73 R; 123/73 AA; 123/73 PP

[58] Field of Search ..... 123/73 R, 73 A, 73 AA, 123/73 AC, 73 AE, 73 B, 73 C, 73 PP, 73 SP

[56] References Cited

U.S. PATENT DOCUMENTS

| | | | |
|---|---|---|---|
| 1,186,299 | 6/1916 | Eighmie | 123/73 A |
| 2,189,357 | 2/1940 | Cull | 123/73 A |
| 2,627,255 | 2/1953 | Kiekhaefer | 123/73 A |
| 3,257,998 | 6/1966 | Brooks | 123/73 AA |
| 3,379,179 | 4/1968 | Mantzel | 123/73 R |
| 4,066,050 | 1/1978 | Ford-Dann | 123/73 A |
| 4,075,985 | 2/1978 | Iwai | 123/73 A |

FOREIGN PATENT DOCUMENTS

| | | | |
|---|---|---|---|
| 441668 | 1/1936 | United Kingdom | 123/73 PP |

*Primary Examiner*—Charles J. Myhre
*Assistant Examiner*—David D. Reynolds
*Attorney, Agent, or Firm*—Sughrue, Rothwell, Mion, Zinn and Macpeak

[57] ABSTRACT

A two cycle loop scavenging engine of the crankcase precompression type having a pair of equally dimensioned scavenging passages 14, 16 disposed in a cylinder block 10 behind an apertured cylinder line 12. The passages are symmetrically positioned on opposite sides of a vertical plane A including the cylinder axis and oriented at an angle $\theta$ to a plane normal to the crankshaft 17. Recessed notches 22, 23 in the lower periphery of the piston skirt 20*a* mate with notches 12*e*, 12*f*, respectively, in the bottom of the cylinder liner at the entrances to scavenging passages 14, 16 at the bottom of each piston stroke. The notches 22, 23 have unequal cross-sectional areas to compensate for unequal fuel mixture pressures at the scavenging passage entrances caused by the rotation of the crankweb 17*a*, thereby producing a more uniform fuel mixture distribution in the cylinder.

5 Claims, 6 Drawing Figures

TWO CYCLE LOOP SCAVENGING ENGINE HAVING UNEQUAL SCAVENGING PASSAGE OPENINGS

BACKGROUND OF THE INVENTION

This invention relates to a two cycle crankcase precompression type of loop scavenging engine having means to compensate for unequal fuel mixture pressures at the scavenging passage entrances caused by the rotation of the crankweb.

Two cycle crankcase precompression engines of the loop scavenging type are commonly used in marine outboard motors, wherein it is essential that the overall engine construction be as compact as possible. Such an engine typically has two or more vertically aligned cylinders and separately partitioned crankchambers, with the fuel mixture being precompressed in each crankchamber during the power stroke of the piston and forceably vented into its associated cylinder scavenging passages whose outlets are uncovered by the piston near the bottom of its power stroke. The scavenging passages are usually disposed on opposite sides of the cylinder at an upwardly converging angle to effect a swirling flow within the cylinder to more effectively scavenge out the exhaust gases and uniformly introduce the new fuel mixture.

To shorten the length of the cylinder block in such an engine in order to achieve a more compact construction, it is known to symmetrically dispose the scavenging passages on the opposite sides of a plane including the crankshaft and cylinder axes, and to orient the exhaust port or ports in a downwardly direction pursuant to an underwater exhaust system. See, for example, U.S. Pat. No. 2,627,255 to Kiekhaefer. In such a construction, however, the rotation of the crankweb in each crankchamber causes a higher pressure at the entrance of one scavenging passage than at the other, which results in inefficient scavenging, non-uniform fuel mixture distribution and degraded combustion and power characteristics. In the full load operation of an outboard motor this problem is particularly serious, since in addition to excessive fuel consumption the supply of lubricating oil is diminished to the sliding surfaces on the weaker scavenging flow side of the cylinder.

Of course, such unequal scavenging passage pressures can be avoided by "rotating" each cylinder 90° so that the passages are symmetrical about a plane perpendicular to the crankshaft, but then the scavenging passages of adjacent cylinders interfere with each other and the length of the cylinder block must be increased to avoid such interference. It is also known to only partially "rotate" the cylinders as disclosed in U.S. Pat. No. 4,075,985. While this avoids scavenging passage interference, some unequal pressure distribution still exists and optimum scavenging efficiency cannot be achieved.

SUMMARY OF THE INVENTION

Briefly, and in accordance with the present invention, the drawbacks and disadvantages of the prior art noted above are effectively overcome by providing recessed notches in the lower periphery of a piston skirt that mate with notches in the bottom of a cylinder liner at the entrances to the scavenging passages at the bottom of each piston stroke. At the same time the upper portion of the piston uncovers scavenging passage exits in the upper portion of the cylinder liner. The piston skirt notches have unequal cross-sectional areas to compensate for unequal fuel mixture pressures at the scavenging passage entrances caused by the rotation of the crankweb, thereby producing a more uniform fuel mixture distribution in the cylinder and more effective exhaust gas scavenging.

The concept of the invention can thus be easily implemented in an existing engine merely by exchanging the present pistons thereof for pistons having unequal recessed notches in accordance with the invention.

Alternatively, the same effect can also be achieved by changing cylinder liners to provide a smaller exit opening for the high pressure scavenging passage, or by reducing the size of the high pressure scavenging passage entrance opening within the crankchamber—as by enlarging the cylinder block adjacent such entrance opening to restrict its cross-sectional area.

DETAILED DESCRIPTION OF THE PREFERRED EMBODIMENTS

Figure 2:
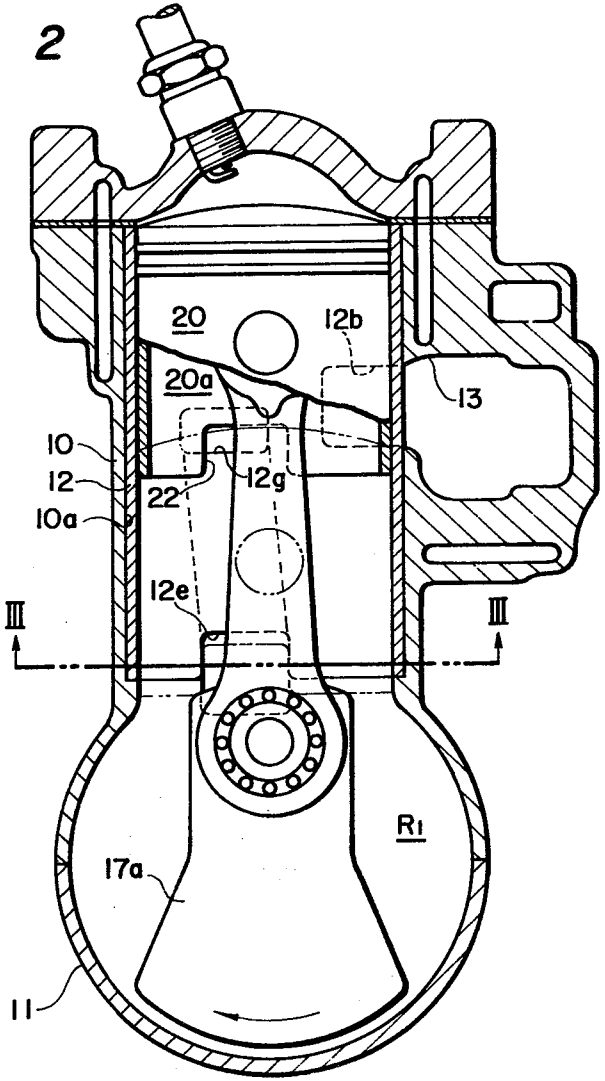
FIG. 2 shows a vertical cross-sectional view as seen from the right side of the engine.
Figure 1:
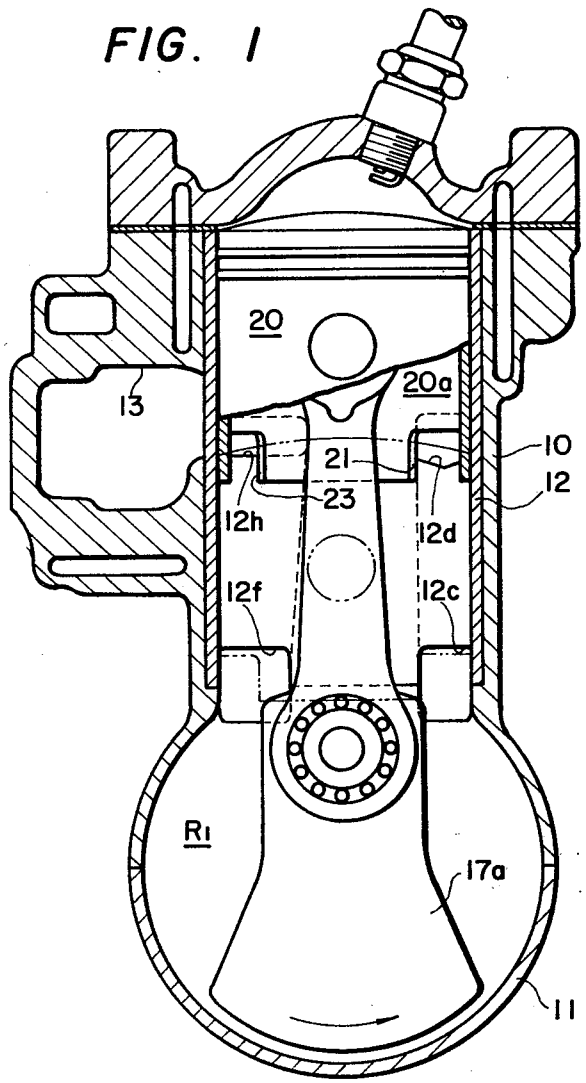
FIG. 1 shows a vertical cross-sectional view of an engine constructed in accordance with the present invention as seen from one side (hereinafter designated the left side)

Referring now to the drawings, an engine or cylinder block 10 defines a pair of cylinders in each of which is mounted a cylinder liner 12 and a reciprocatingly slidable piston 20 coupled via a connecting rod to a crankshaft 17 within a crankcase 11. A water jacketed exhaust passage 13 is also defined within the cylinder block, and the crankshaft is provided with counterbalancing crankwebs **17*a*** each disposed within a separately partitioned or sealed crankchamber R1.

Figure 3:
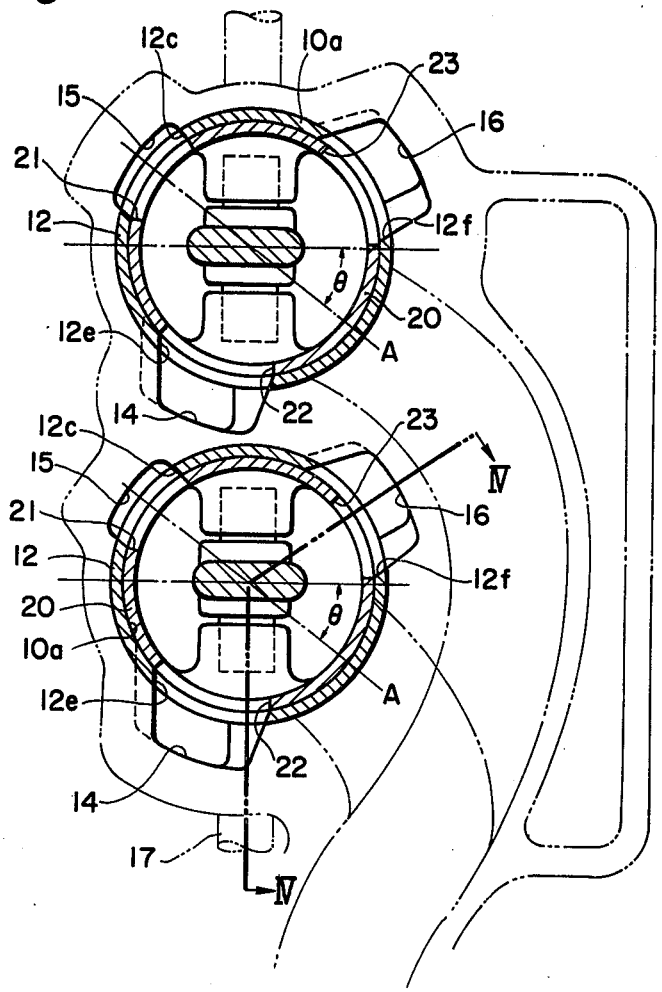
FIG. 3 shows a horizontal cross-sectional view of the engine as seen from below, taken along line III—III in FIG. 2.

Scavenging passages 14, 15 and 16 are defined in the cylinder block behind each cylinder liner 12, with passages 14 and 16 being symmetrically disposed on opposite sides of a plane A (FIG. 3) including the cylinder axis and lying at an angle $\theta$ with respect to a plane perpendicular to the crankshaft axis. Scavenging passage 15 is bisected by plane A.

Figure 5:
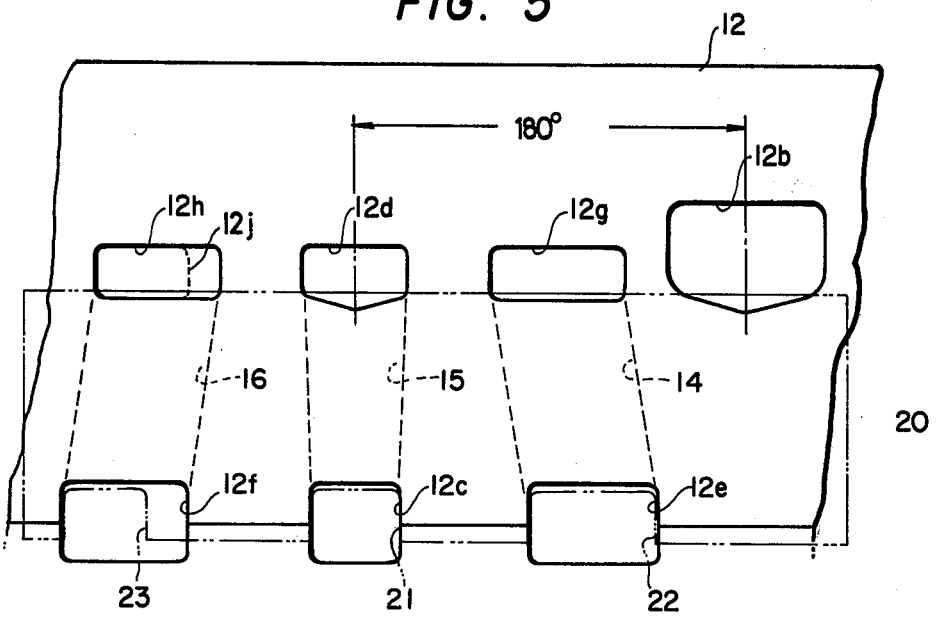
FIG. 5 shows an open development of the cylinder liner and piston skirt.

The cylinder liner 12, as best seen in the open development view of FIG. 5, has an exhaust port **12*b* mating with the exhaust passage 13, scavenging passage exit ports 12*g*, 12*d* and 12*h* mating with the upper ends of the passages 14, 15 and 16, respectively, and recessed notches 12*e*, 12*c* and 12*f* respectively mating with the lower or entrance ends of such passages. The scavenging passages 14 and 16 are disposed at an upwardly converging angle to produce a looping type of flow within the cylinder in accordance with conventional practice. The lower portion or skirt 20*a* of each pistion 20 has recessed notches 21, 22 and 23 in its periphery respectively mating with notches 12*c*, 12*e* and 12*f* in the lower portion of the cylinder liner 12** at the entrance ends of the scavenging passages.

In accordance with a preferred embodiment of the present invention the cross-sectional area of notch 23 in the piston skirt is made smaller than that of notch 22. Since the entrance opening of scavenging passage 16 is on the high pressure side of the crankchamber R1 due to the rotation of crankweb 17*a*, the relatively smaller area of notch 23 thus restricts the entrance to passage 16 and results in substantially equal fuel mixture charges being forceably vented through the passages 14 and 16 during each scavenging cycle. This in turn results in more effective and efficient exhaust gas scavenging, a more uniform distribution of the new fuel mixture, attendantly increased combustion and power characteristics, reduced fuel consumption, and lastly, improved and more uniform lubrication of the sliding parts within each cylinder by the unvaporized oil in the fuel mixture.

The scavenging action takes place in a known manner when, near the bottom of each piston power stroke, the exit ports of the scavenging passages are uncovered by the descending piston shortly after the exhaust port 12*b* is uncovered.

Figure 4:
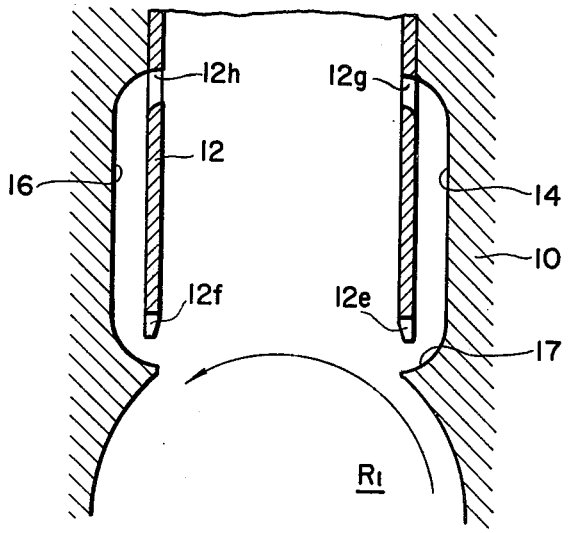
FIG. 4 shows a simplified vertical cross-sectional view taken along line IV—IV in FIG. 3.
Figure 6:
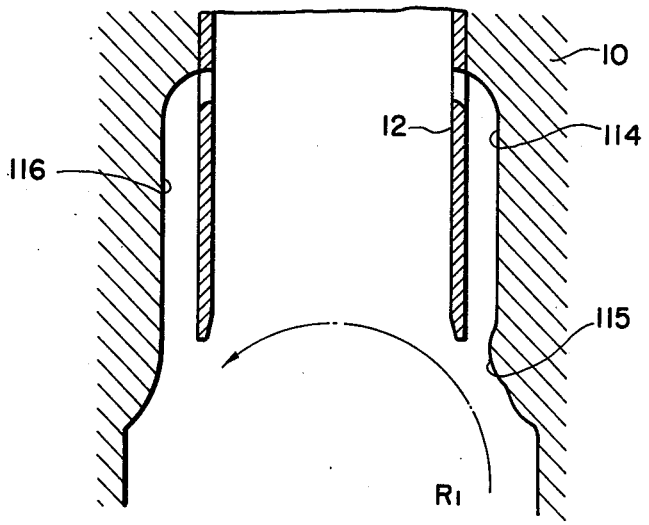
FIG. 6 shows a partial cross-sectional view of a further embodiment.

It is to be understood that the invention is not limited to an equally notched piston skirt as described above, since the same effects can equally be achieved, for example, by reducing the size of the exit port 12*h* of the high pressure scavenging passage 16, as shown by dotted line 12*j*, or by reducing the size of the entrance notch 12*f* thereof in the cylinder liner 12. As a further alternative, as illustrated in FIG. 6, the entrance opening to the high pressure side scavenging passage 114 can be reduced by providing a bulbous protrusion 115 on the cylinder block adjacent such entrance opening—thereby equalizing the fuel charge flows through the passages 114 and 116. In this embodiment the inwardly extending lips 117 of the cylinder block shown in FIG. 4 have also been removed, whereby the rotating crankweb creats higher pressure at the entrance of passage 114—just the reverse of the first embodiment.

What is claimed is:

1. In a crankcase precompression type of two cycle engine including a cylinder block defining a cylinder therein, a skirted piston reciprocatingly and slidably disposed within the cylinder, a crankshaft including a crankweb rotatably mounted in a crankchamber beneath the cylinder block, a connecting rod coupling the piston to the crankshaft, and a pair of scavenging passages defined in the cylinder block for forceably venting precompressed fuel mixture from the crankchamber into the cylinder near the end of each power stroke of the piston, said passages being symmetrically disposed on opposite sides of a plane including the cylinder axis and lying at a predetermined angle unequal to zero with respect to a plane perpendicular to the crankshaft axis, whereby the rotation of the crankweb creates a higher pressure at an entrance of one scavenging passage than at an entrance of the other scavenging passage, the improvement characterized by:

means for restricting the effective cross-sectional area of the high pressure scavenging passage at at least one point thereof to thereby substantially equalize the fuel mixture charges forceably vented through the respective scavenging passages.

2. An engine as defined in claim 1, wherein the restricting means comprises a pair of recessed notches in the periphery of the piston skirt adapted to mate with the respective scavenging passage entrances at the bottom of each piston stroke, the notch mating with the high pressure scavenging passage entrance having a smaller cross-sectional area than the other notch.

3. An engine as defined in claim 1, wherein the restricting means comprises a cylinder liner having a pair of ports therein respectively mating with the scavenging passage exits, the port mating with the high pressure scavenging passage exit having a smaller cross-sectional area than the other port.

4. An engine as defined in claim 1, wherein the restricting means comprises a cylinder liner having a pair of port therein respectively mating with the scavenging passage exits and a pair of recessed notches in its lower periphery respectively mating with the scavenging passage entrances, the notch mating with the high pressure scavenging passage entrance having a smaller cross-sectional area than the other notch.

5. An engine as defined in claim 1, wherein the restricting means comprises a bulbous protrusion on the wall of the cylinder block adjacent the entrance to the high pressure scavenging passage.

* * * * *